United States Patent [19]

Inoue

[11] 4,354,363

[45] Oct. 19, 1982

[54] MEANS FOR CONTROLLING THE MOVEMENT OF YARN CARRIERS ALONG WITH A CARRIAGE IN FLAT KNITTING MACHINES

[75] Inventor: Hideo Inoue, Wakayama, Japan

[73] Assignee: Shima Idea Center Co., Ltd., Wakayama, Japan

[21] Appl. No.: 212,910

[22] Filed: Dec. 4, 1980

[30] Foreign Application Priority Data

Dec. 10, 1979 [JP] Japan ..... 54-159976

[51] Int. Cl.[3] ..... D04B 15/52

[52] U.S. Cl. ..... 66/128; 66/126 R

[58] Field of Search ..... 66/126 R, 127, 128, 66/75.2, 70

[56] References Cited

U.S. PATENT DOCUMENTS

| | | | |
|---|---|---|---|
| 3,053,065 | 9/1962 | Steiger | 66/126 R |
| 4,052,865 | 10/1977 | Zamarco | 66/128 |
| 4,179,906 | 12/1979 | Patthey | 66/128 |
| 4,192,157 | 3/1980 | Hida et al. | 66/70 X |
| 4,269,045 | 5/1981 | Hida et al. | 66/75.2 |

*Primary Examiner*—Ronald Feldbaum

[57] ABSTRACT

An apparatus for selectively controlling yarn carriers for movement along with a carriage in a flat knitting machine. A trick location detector is provided on the carriage for detecting varying positions, expressed in terms of the number of tricks from one or the other tricked end of a needle bed, of the carriage on the needle bed during its run thereon. Coupling plungers in a plunger box on the carriage are controlled by solenoids in such a way that the plungers each is actuated to slide to its operative position relative to one of the yarn carriers for engagement therewith so that the yarn carrier so engaged by the plunger is carried along by the carriage over the predetermined distance. A control unit is provided which includes, among others, a trick position setting device adapted to memorize predetermined signalling positions based on color data, each such position expressed in terms of the number of tricks counted from one or the other tricked end of the needle bed, for energizing and deenergizing the solenoids. There are provided solenoid drive circuits which are controlled through arithmetical operation of the values detected by the trick location detector and the data stored in the trick position setting device, so that the coupling plungers may be selectively controlled for engagement with and disengagement from the yarn carriers.

2 Claims, 4 Drawing Figures

FIG. 4

| Course No. | 1 | 2 | 3 | 4 | 5 |
|---|---|---|---|---|---|
| Energize/deenergize solenoid | 1 | 1 | 1 | | |
| Yarn-carrier selection | 1 | 8 | 1 | | |
| Trick location | 0<br>0<br>0 | 9<br>6<br>0 | 0<br>0<br>0 | | |
| Energize/deenergize solenoid | 0 | 0 | (The rest is omitted) | | |
| Yarn-carrier selection | 1 | 8 | | | |
| Trick location | 1<br>0<br>0 | 8<br>6<br>0 | | | |
| Energize/deenergize solenoid | 1 | 1 | | | |
| Yarn-carrier selection | 2 | 7 | | | |
| Trick location | 1<br>0<br>0 | 8<br>6<br>0 | | | |
| Energize/deenergize solenoid | 0 | 0 | | | |
| Yarn-carrier selection | 2 | 7 | | | |

MEANS FOR CONTROLLING THE MOVEMENT OF YARN CARRIERS ALONG WITH A CARRIAGE IN FLAT KNITTING MACHINES

BACKGROUND AND SUMMARY OF THE INVENTION

The present invention relates to control means, in a flat knitting machine having a plurality of yarn carriers on carrier guide rails provided above and longitudinally along a needle bed, for selectively controlling the yarn carriers for movement along with the carriage.

In conventional flat knitting machines of the type having a plurality of yarn carriers movably mounted on carrier guide rails, there is usually provided on a carriage a plunger box in which are disposed a suitable number of coupling plungers, each slidable to a hooking-on or operative position relative to one of the yarn carriers for engagement therewith, so that fancy pattern knitting can be performed by selectively changing the yarn carriers to be carried along by the carriage through selective control of the coupling plungers for engagement with and disengagement from the yarn carriers. In such machines the yarn carriers are selectively moved along with the carriage through the coupling plungers, which are selectively controlled to their operative position or inoperative position relative to the yarn carriers before the carriage proceeds into a given part of its path of movement. It is also known to provide stoppers on the carrier guide rails so that the distance over which the selected yarn carrier is carried along by the carriage can be limited by selectively controlling the stoppers for displacement. Such arrangement is disclosed in U.S. Pat. No. 4,052,865 and U.S. Pat. No. 4,179,906, for example.

The present invention has for its object the provision of means for controlling the movement of yarn carriers along with a carriage which eliminate the need for stoppers, an essential feature of the prior-art arrangement, and which thereby substantially simplify the mechanical arrangement employed in the prior art machines for selective control of the yarn carriers for movement along with the carriage. More concretely, the invention consists essentially in: means for controlling the movement of yarn carriers along with a carriage in a flat knitting machine, comprising a trick location detector mounted on the carriage for detecting varying positions of the carriage on a needle bed during its movement thereon, each such position expressed in terms of the number of tricks or of needles counted from one or the other tricked end of the needle bed, a plurality of solenoids arranged in a plunger box on the carriage for individually controlling coupling plungers provided in the plunger box in the same number as the solenoids, each coupling plunger slidable to an operative position relative to one of the yarn carriers on carrier guide rails for engagement therewith, each of said solenoids connected to a solenoid drive circuit, trick position setting means adapted to memorize any predetermined signalling positions, each expressed in terms of the number of tricks counted from one or the other end of the needle bed, for selectively energizing and deenergizing the solenoids, and a control unit for controlling the solenoid drive circuit through the operation of values memorized by the trick position setting means and those detected by the trick location detector.

BRIEF DESCRIPTION OF THE DRAWINGS

FIG. 4 is a memory chart showing an instruction register by way of example;

DETAILED DESCRIPTION OF THE PREFERRED EMBODIMENTS

Figure 1:
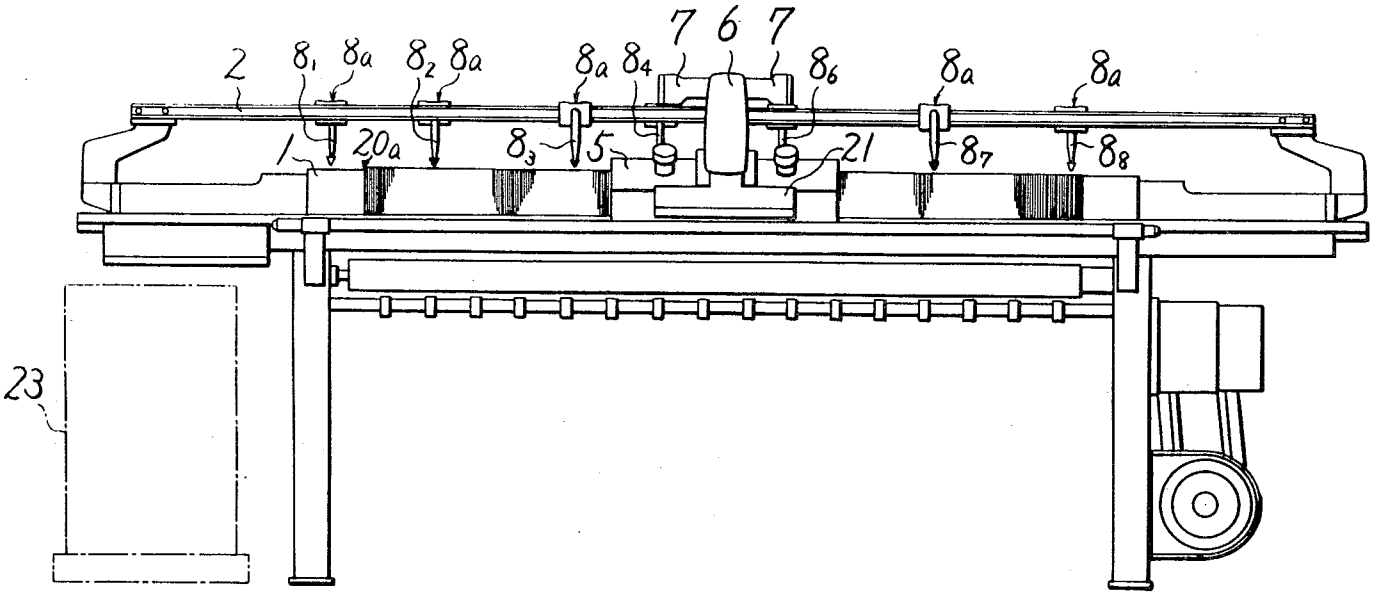
FIG. 1 is a front view of a flat knitting machine incorporating an embodiment of the present invention.

Referring now to the embodiment of the invention shown in the drawing, FIG. 1 in particular, there are disposed a required number of carrier guide rails 2 above and longitudinally along a needle bed 1 (which is to be understood to be a pair of needle beds disposed in opposed relationship to each other), and on the carrier guide rails 2 there are mounted a suitable number of yarn carriers $\mathbf{8_1}$–$\mathbf{8_2}$ (eight in the embodiment shown) for free slidable movement therealong. No stopper means of the type employed in the prior art machines are present on the carrier guide rails 2.

Figure 2:
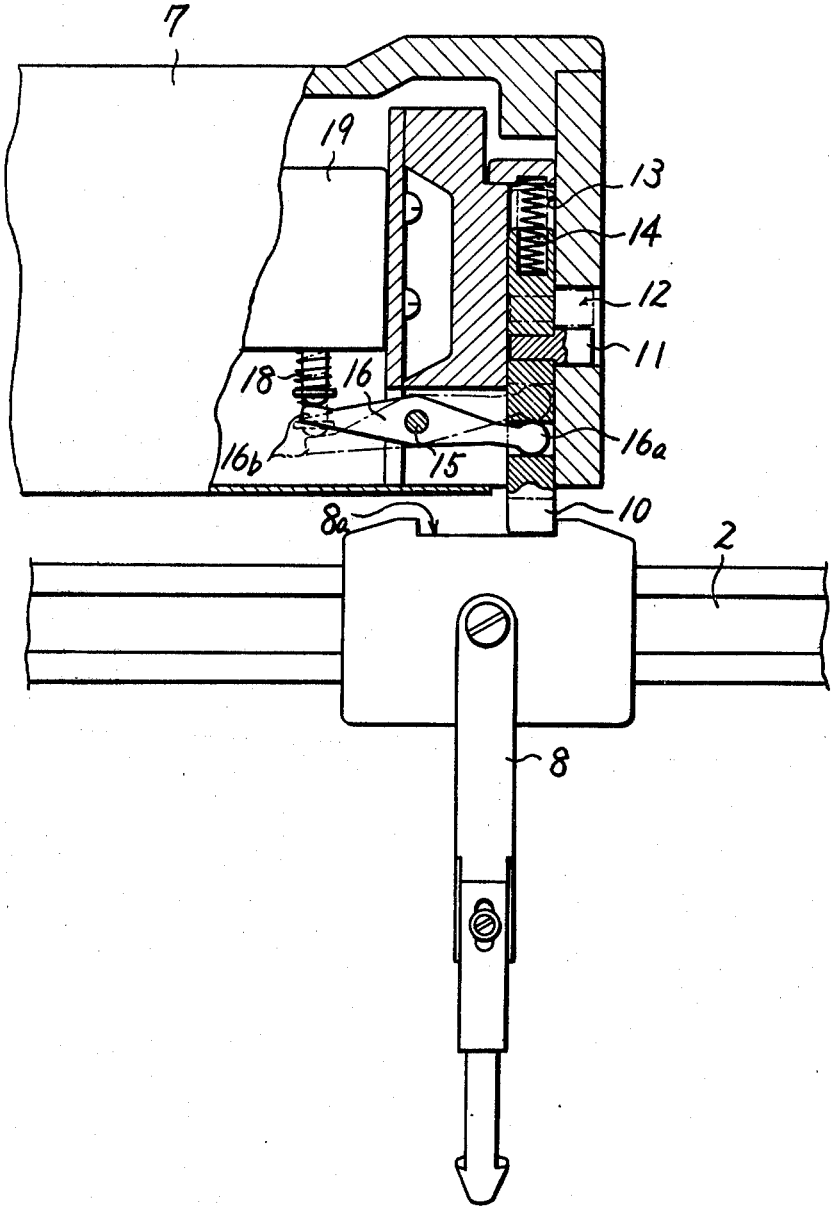
FIG. 2 is a sectional view of a plunger box, showing a coupling plunger in conjunction with a yarn carrier.

A plunger box 7 is seen above the carrier guide rails 2. It is mounted on and integrally with a connecting arm 6 which bridges the carrier guide rails to connect between a pair of cam boxes of a carriage 5 which moves back and forth on the needle beds. In the plunger box 7 there are provided eight coupling plungers $\mathbf{10_1}$–$\mathbf{10_8}$ adapted to individually act on the yarn carriers $\mathbf{8_1}$–$\mathbf{8_8}$ on the carrier rails for selectively causing the yarn carriers to be carried along by the carriage 5, each of said plunger being upwardly and downwardly slidable through an opening provided in the plunger box 7. In FIG. 2 one of the plungers, generally designated 10, is illustrated in detail. The plunger 10 has its up and down stroke limited within the movable range of a pin 11 sidewardly projecting therefrom in a hole 12 formed in the plunger box 7 and is urged downward by a spring means 14 provided between the base of a hole 13 in which the plunger 10 is up and down slidably supported and the upper end of the plunger 10. In the plunger box 7 the plunger 10 is connected to a lever 16 at one end **16*a* thereof (point of force application), the lever 16 being pivotable about a fulcrum 15**.

In the plunger box 7 there are also provided solenoids 19 ($\mathbf{19_1}$–$\mathbf{19_8}$) in the same number as the plungers 10, said solenoids each provided with a movable core 18 which can be held in two positions, projected and retracted. Said movable core 18, when it is in its projected state, is in contact at its lower end with the other end **16*b* (point of force) of the lever 16 so that if the solenoid 19 is energized the core 18 retracts to allow the plunger 10 to project downwardly, whereas if the solenoid 19 is deenergized the core 18 projects to allow the plunger 10** to retract upwardly.

The coupling plungers $\mathbf{10_1}$–$\mathbf{10_8}$ provided in the plunger box 7 as above described are so designed that when any of them is downwardly projected its lower end is positioned in an operative position relative to one of the yarn carriers $\mathbf{8_1}$–$\mathbf{8_8}$ on the carrier rails for engagement with a recess **8*a* of the yarn carrier, whereas when the plunger is upwardly retracted its lower end is positioned in an inoperative position for disengagement from the recess 8*a***.

As already mentioned, the control means for the movement of yarn carriers along with the carriage in accordance with the present invention include no such stopper means on the carrier guide rails as are designed to act on each plunger $10_1$–$10_8$ for disengagement thereof from said recess 8*a* and to thereby stop the yarn carriers $8_1$–$8_8$. The coupling plungers $8_1$–$8_8$ each is actuated to be positioned in its operative position or inoperative position relative to one of the yarn carriers $8_1$–$8_8$ only when the solenoid 19 specifically assigned to act on each individual plunger is energized or deenergized at a suitable point during the movement of the carriage 5, so that the yarn carriers $8_1$–$8_8$ can be selectively carried along by the carriage 5 over their respective predetermined paths of stroke.

For this purpose, there is provided at a suitable location on the carriage 5 a trick location detector 21 adapted to detect varying positions of the carriage 5 on the needle bed 1 during it movement thereon, each such position expressed in terms of the number of tricks or of needles counted from one or the other tricked end of the needle bed. As can be seen from FIG. 3, the data representing the number of tricks or of needles so detected by the trick location detector 21 enters a main operational circuit 24, which is a main part of a control unit 23 provided in the knitting machine, via an amplifying and shaping circuit 22.

The control unit 23 includes a trick position setting means 27 consisting of a color-yarn changeover point input circuit 25 and a solenoid energizing/deenergizing point memory circuit 26. The trick position setting means 27 is adapted to memorize predetermined signalling positions based on color data stored in memory elements such as magnetic tape or punched card, each such position expressed in terms of the number of tricks or of needles counted from one or the other tricked end of the needle bed, for energizing and deenergizing the solenoids. Any data memorized by the trick position setting means 27 enters the main operational circuit 24.

The data thus entering the main operational circuit 24, that is, every detected value (number of tricks) from the trick location detector 21 and memorized values (solenoid selection for each course and solenoid energizing and/or deenergizing points, each expressed in terms of the number of tricks) from the trick position setting means 27, are subjected to arithmetical operation there; and according to the results of the operation, solenoid drive circuits 28, provided in a suitable number, are selectively controlled.

Therefore, when the carriage 5 reaches a particular point on the needle bed that is specified by the data stored in the memory element, the selected coupling plunger 10 is actuated for displacement to its operative position relative to the yarn carrier 8 then positioned in opposite relation thereto, while the previously selected plunger 10 is actuated for displacement to its inoperative position relative to the yarn carrier 8 coupled thereto, and accordingly the first mentioned yarn carrier 8 is coupled to the selected plunger 10 for movement along with the carriage 5 over the predetermined distance.

For example, let us now assume that the flat knitting machine shown in FIG. 1 has 960 tricks in each one of its pair of needle beds, that data for solenoid energizing and deenergizing points are stored in the trick position setting means 27 as shown in FIG. 4, and that in each numeric expression of five digits shown in FIG. 4, the first digit indicates "energize" (1) or "deenergize" (0), the second digit indicates selected solenoid number (1–8), and the third to fifth digits indicates the number of tricks counted from the left tricked end 20*a* of the needle bed; then, the yarn carries 1–8 may be controlled by the control means of the invention in the following way.

In knitting operation for the first course, the solenoid $19_1$ is energized at position "0" (number of tricks=0) at the left tricked end of the needle bed and deenergized at position "100" (number of tricks=100) and accordingly the coupling plunger $10_1$ is actuated at trick position "0" for displacement to its operative position relative to the yarn carrier $8_1$ positioned in opposite relation thereto so that the yarn carrier $8_1$ is coupled to the plunger $10_1$ for movement along with the carriage 5 over the distance between trick position "0" and trick position "100". Then, at trick position "100" the solenoid $19_2$ is energized, it being deenergized at porition "200". Accordingly, the yarn carrier $8_2$ is carried along by the carriage 5 through the plunger $8_2$ over the distance between position "100" and position "200". The subsequent process of the first course knitting may be self-explanatory.

Likewise, in knitting operation for the second course, the yarn carrier $8_8$ is carried along by the carriage over the distance between position 960 and position 860. Then, between position 860 and position 760, the carriage 5 is accompanied by the yarn carrier $8_7$.

As can be clearly understood from the above description, the means for controlling the movement of yarn carriers along with the carriage in accordance with the present invention permit the yarn carriers to be carried along by the carriage over a distance predetermined for movement of each individual yarn carrier during each stroke of the carriage, without providing on the yarn carrier rails such stopper means having a cam surface adapted to act on a coupling plunger for engagement with and disengagement from a recess thereof as are often employed in the known control apparatuses.

Figure 5:
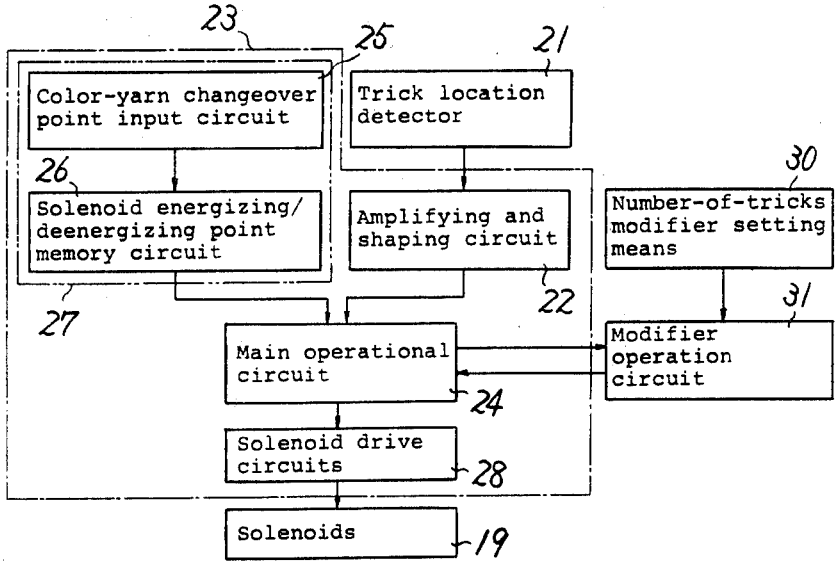
FIG. 5 is a block diagram of a control circuitry illustrating another form of the invention.

A modified form of the invention is illustrated in FIG. 5. It represents some improvement over the first embodiment in that it provides means for adjusting any time lag that may occur with respect to solenoid energizing and deenergizing points depending upon the velocity of carriage movement, etc., such time lag to be expressed in terms of the number of tricks. In other respects, the second embodiment is of same construction as the first embodiment.

Figure 3:
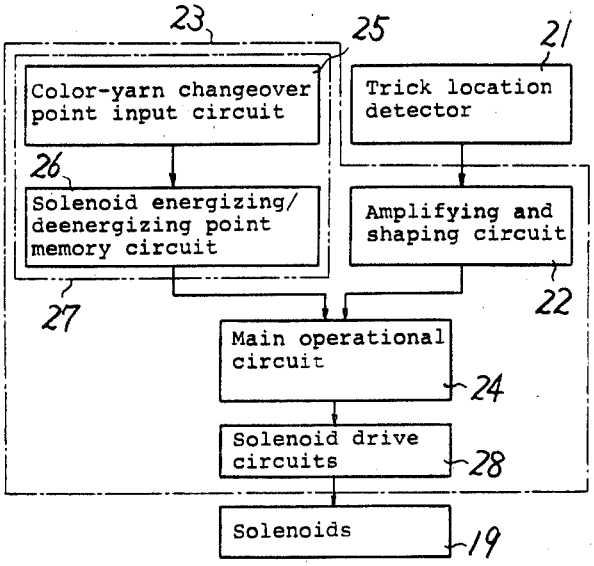
FIG. 3 is a block diagram of a control circuitry.

In FIG. 5, the parts identical with those shown in FIG. 3 are indicated by same reference numerals as in FIG. 3. As shown, a number-of-tricks modifier setting means 30 is added to the control means already described, and a modifier operation circuit 31 is connected to the main operational circuit 24 of the control unit.

The number-of-tricks modifier setting means 30 is adapted to set and memorize modifiers for advancing and/or delaying predetermined signalling positions, each expressed in terms of the number of tricks counted from one or the other end of the needle bed, for selectively energizing and deenergizing the solenoids $19_1$–$19_8$, within the limit of ±50 tricks, for example, depending upon the velocity of carriage movement during knitting operation and other variables. The modifiers so set and memorized by the number-of-needles modifier setting means are subjected to arithmetical operation in a modifier operation circuit 31 and the resulting modified energizing and deenergizing signals are transmitted to solenoid drive circuits 28 through the main operational circuit 24. The incorporation of such adjusting mechanism into the first embodiment of the invention permits accurate adjustment of the predetermined signalling positions for factors such as yarn-carrier changeover position errors due to selected carriage run speed and changes in resisting force against yarn-carrier run resulting from wear caused to yarn carrier or carrier guide rail so that the yarn carriers may be positively controlled for changeover at the desired points as per the data stored in the control unit.

I claim:

1. Means for controlling the movement of yarn carriers along with a carriage in a flat knitting machine, comprising a trick location detector mounted on the carriage for detecting varying positions of the carriage on a needle bed during its movement thereon, each such position expressed in terms of the number of tricks or of needles counted from one or the other tricked end of the needle bed, a plurality of solenoids arranged in a plunger box on the carriage for individually controlling coupling plungers provided in the plunger box in the same number as the solenoids, each coupling plunger slidable to an operative position relative to one of the yarn carriers on carrier guide rails for engagement therewith, each of said solenoids connected to a solenoid drive circuit, trick position setting means adapted to memorize predetermined signalling positions, each expressed in terms of the number of tricks counted from one or the other tricked end of the needle bed, for selectively energizing and deenergizing the solenoids, and a control unit for controlling the solenoid drive circuit through the operation of values memorized by the trick position setting means and those detected by the trick location detector.

2. Means for controlling the movement of yarn carriers along with a carriage in a flat knitting machine, comprising a trick location detector mounted on the carriage for detecting varying positions of the carriage on a needle bed during its movement thereon, each such position expressed as the number of tricks or of needles counted from one or the other tricked end of the needle bed, a plurality of solenoids arranged in a plunger box on the carriage for individually controlling coupling plungers provided in the plunger box in the same number as the solenoids, each coupling plunger slidable to an operative position relative to one of the yarn carriers on carrier guide rails for engagement therewith, each of said solenoids connected to a solenoid drive circuit, trick position setting means adapted to memorize predetermined signalling positions, each expressed in terms of the number of tricks counted from one or the other tricked end of the needle bed, for selectively energizing and deenergizing the solenoids, number-of-tricks modifier setting means adapted to set and memorize signalling-position modifiers, each expressed as a plus or minus value relative to the value for the predetermined signalling position expressed in terms of the number of tricks counted from one or the other tricked end of the needle bed, for altering predetermined signalling positions for selectively energizing and deenergizing the solenoids, and a control unit for controlling the solenoid drive circuit through the operation of values memorized by the trick position setting means and number-of-tricks modifier setting means and those detected by the trick location detector.

* * * * *